United States Patent [19]

Gröss

[11] Patent Number: 4,630,994

[45] Date of Patent: Dec. 23, 1986

[54] APPARATUS FOR AXIALLY AND CIRCUMFERENTIALLY LOCKING STATIONARY CASING COMPONENTS OF TURBOMACHINES

[75] Inventor: Helmut Gröss, Esterhofen, Fed. Rep. of Germany

[73] Assignee: Motoren-und Turbinen Union Munchen GmbH, Munich, Fed. Rep. of Germany

[21] Appl. No.: 648,801

[22] Filed: Sep. 7, 1984

[30] Foreign Application Priority Data

Sep. 16, 1983 [DE] Fed. Rep. of Germany ..... 3333436

[51] Int. Cl.[4] ..... F01D 1/02

[52] U.S. Cl. ..... 415/190; 415/219 R; 403/358

[58] Field of Search ..... 415/189, 190, 139, 219 R; 403/358, 355, 338; 29/526 R

[56] References Cited

U.S. PATENT DOCUMENTS

| | | | |
|---|---|---|---|
| 1,169,513 | 1/1916 | Royle, Jr. | 403/358 |
| 1,673,151 | 6/1928 | Lindemann | 415/189 |
| 3,423,071 | 1/1969 | Noren | 415/189 |
| 3,542,483 | 11/1970 | Gagliardi | 415/139 |
| 3,817,655 | 6/1974 | Huesgen et al. | 415/219 R |
| 3,842,595 | 10/1974 | Smith et al. | 415/189 |
| 3,892,497 | 7/1975 | Gunderlock et al. | 415/139 |
| 4,083,648 | 4/1978 | Asplund | 415/189 |
| 4,391,565 | 7/1983 | Speak | 415/189 |

FOREIGN PATENT DOCUMENTS

| | | | |
|---|---|---|---|
| 629283 | 10/1961 | Canada | 415/139 |
| 432878 | 3/1948 | Italy | 415/219 R |
| 590888 | 4/1959 | Italy | 415/189 |
| 428112 | 5/1975 | U.S.S.R. | 415/219 R |

*Primary Examiner*—Louis J. Casaregola
*Assistant Examiner*—Donald E. Stout
*Attorney, Agent, or Firm*—Roberts, Spiecens & Cohen

[57] ABSTRACT

A device for axially and circumferentially locking two stationary components of a turbomachine, each of which is at least part of a ring and wherein the components are concentrically engaged along opposed surfaces. The device comprises a locking member including a disc portion and an axially projecting angular segment on the disc portion forming a step thereon. The components have axially aligned intercommunicating hollows, the hollow of a first of the components having a laterally open recess. The locking member is engaged in the hollow of the stationary components in a locking position by inserting the disc portion into the hollow of the first component through the recess thereof, then axially displacing the locking member to engage the disc portion thereof into the hollow of the second component and thereafter angularly rotating the locking member to engage its angular segment into the hollow of the first component through its recess.

18 Claims, 10 Drawing Figures

X
5
W2
B
8
W1
7
3

1
6
180°
4
15
7'

A
2
C
2a
C
A
11
A
X

APPARATUS FOR AXIALLY AND CIRCUMFERENTIALLY LOCKING STATIONARY CASING COMPONENTS OF TURBOMACHINES

FIELD OF THE INVENTION

The invention relates to apparatus for axially and circumferentially locking stationary components of a turbomachine, and particularly the components of gas turbine engines which have adjoining circumferential surfaces.

PRIOR ART

In known configurations, great difficulties are encountered for example, in the assembly of internal structural components, such as compressor or turbine shrouds of annular or segmented construction or the inner shrouds or segments in the form of seal or vane carriers, into compressor or turbine casings, where the assembly is often obstructed and it is difficult to ensure the requisite degree of operational reliability.

State-of-the-art locking means normally consist of milled recesses in a component in combination with pins or milled or brazed tangs on the mating member. Axial locking is often achieved by tilting the stationary segment members and hooking them into webs in the casing. Other axial locking conditions are achieved by direct bolting (axially or radially through the casing), by piston-ring-type spring members or by slots and claws engaged by the subsequent rotation of the components relative to one another as in a bayonet catch.

All these locking systems require, in common, a comparatively large amount of assembly and much space to work in.

The bolted locking assemblies additionally require a relatively large amount of work for disassembly from the structure of the outer casing.

The mechanisms for engaging components by tilting them has only restricted use, because of the presence of previously installed vanes or seals or other previously installed turbomachine components which interfere with the tilting operation.

Apart from the relatively great effort required for assembly the known constructions are comparatively complex in design, especially the piston-ring-type spring members and the bayonet catch systems which adds to the relatively high cost of the locking means.

As regards pin locking constructions, these are subject to plastic deformation and consequent enlargement of the clearance therein.

SUMMARY OF THE INVENTION

An object of the present invention is to provide a locking device in which the disadvantages of the state-of-the-art constructions are eliminated and which simplifies assembly and still gives optimum operational reliability.

The aforesaid and other objects of the invention are satisfied by a construction of the locking device which comprises a locking member including a disc portion and an axially projecting angular segment on said disc portion forming a step thereon. The components have axially aligned intercommunicating hollows, the hollow of one of said components having a laterally open recess.

The locking member is engaged in the hollows of the stationary components, in a locking position, by inserting the disc portion into said hollow of said one component through said recess thereof, then axially displacing said locking member to engage the disc portion into the hollow of the other component and thereafter angularly rotating said locking member to engage said angular segment into said hollow of said one component through said recess thereof.

The locking device of the invention provides the following advantages:

(a) a strictly axial assembly of the individual angular segments or complete ring is achieved. This permits the use of mutually effective clearance seal members. Previously installed labyrinth seals will not obstruct the assembly as would be case if it was necessary to tilt the segments or ring;

(b) the axial and circumferential locking functions are achieved by a single part, i.e., a locking member;

(c) prevailing forces are favorably distributed over an optionally selected, relatively large diameter of the locking member as compared to small pins whose line pressure often is relatively great causing plastic deformation and enlargement of the pin clearance;

(d) the device is easy to manipulate and assembly is made fool-proof by its special design;

(e) manufacture is relatively economical due to the comparatively simple design.

In accordance with a feature of the invention, the disc portion of the locking member is cylindrical and the angular segment is substantially semi-cylindrical. The hollows in the components are cylindrical and the recess in said one component is a semi-cylindrical extension of its respective cylindrical hollow.

DETAILED DESCRIPTION OF A PREFERRED EMBODIMENT

Figures 1, 2, 3:
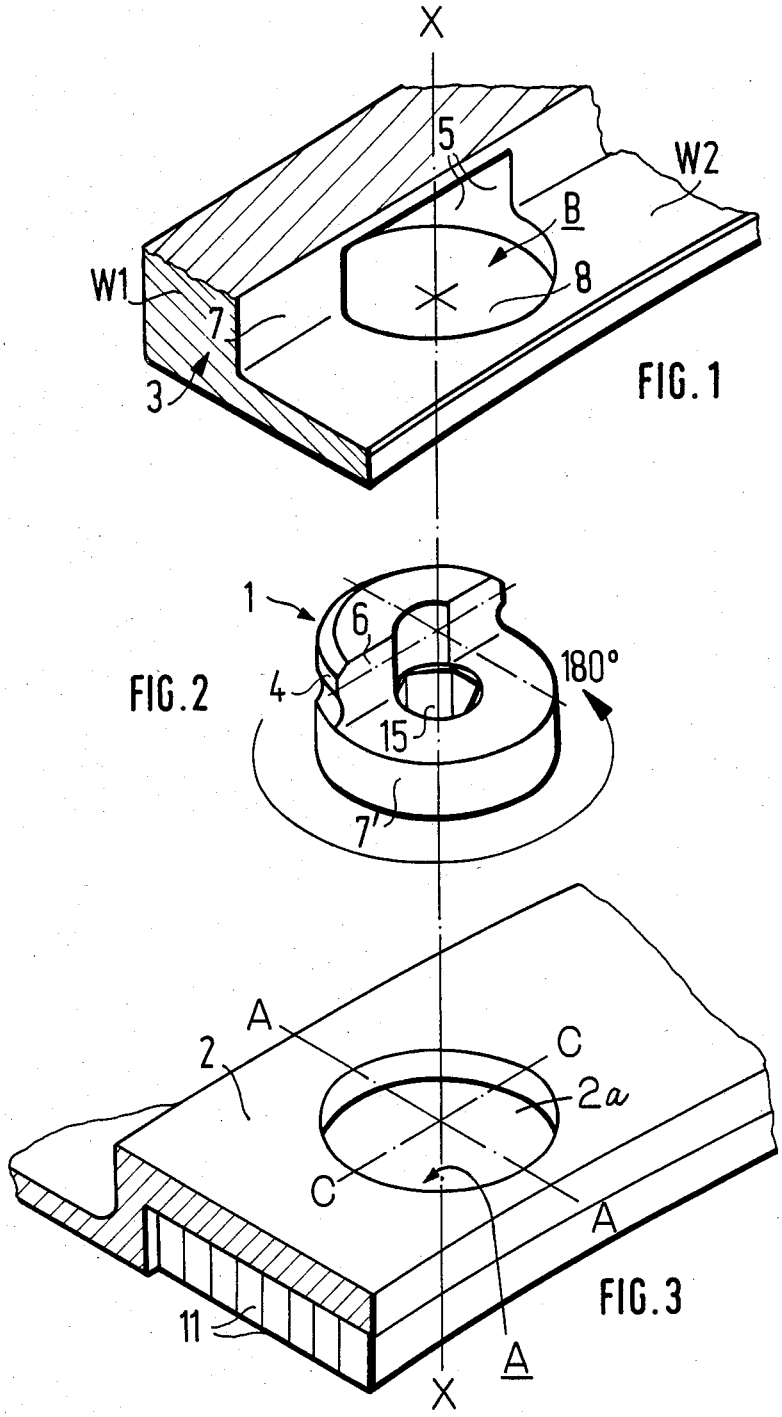
FIG. 1 is a perspective view, partly broken away and in section, of a portion of a turbine casing showing details of the device according to the invention.
FIG. 2 is a perspective view of a locking member according to the invention.
FIG. 3 is a perspective view, partly broken away and in section, of a portion of an internal structural component in the form of a seal carrier to be connected to the casing member of FIG. 1.

FIGS. 1–3 shows a locking member 1 which is adapted to lock first and second stationary components 2 and 3 in adjoining, superimposed relation by engaging in respective hollows A and B in components 2 and 3. Component 3 may be an outer casing of a turbine and component 2 an internal vane seal carrier. In general, the components 2 and 3 are cylindrical and concentric and FIGS. 1 and 3 show only a small angular portion of the components. Each of the cylindrical components 2 and 3 may be formed as an integral ring or composed of individual ring segments which are connected together.

The locking member 1 serves to lock the components 2 and 3 against relative axial movement along axis A—A in FIG. 3 and against relative circumferential movement along axis C—C in FIG. 3.

Generally, in a manner to be explained more fully later, the components 2 and 3 are locked in a position in which hollows A and B are aligned along a common axis X—X. The hollow A is cylindrical and extends only partially into the depth of component 2 so as to be bounded at its lower end by a bottom wall 2*a*. The hollow B is formed by a bore extending through a horizontal wall W2 of component 3 and extending partially in the height of vertical wall W1 to form a semi-circular recess 5 in wall W1 which is open at face 7 of wall W1. The walls W1 and W2 form an L-shaped cross-section as shown in FIG. 1.

As seen in FIG. 2, the locking member 1 comprises a cylindrical disc portion 7' having a stepped, angular segment 4 projecting axially upwards from the upper surface of cylindrical portion 7' and which is slightly less than semi-cylindrical. Namely, the segment 4 has a face 6 which is slightly offset by a distance e(FIG.7) from the axis D—D of cylindrical portion 7' and which lies in a plane parallel to axis D—D.

Figure 6:
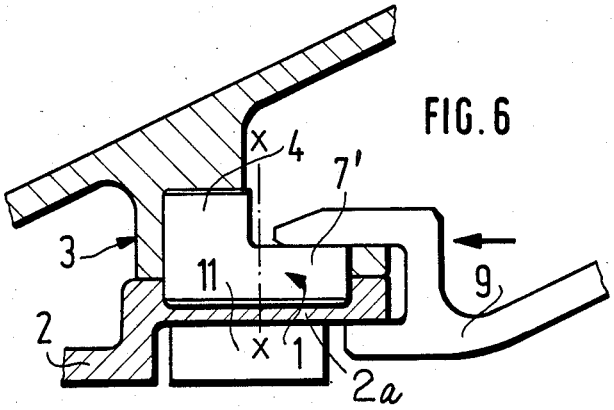
Figure 9:
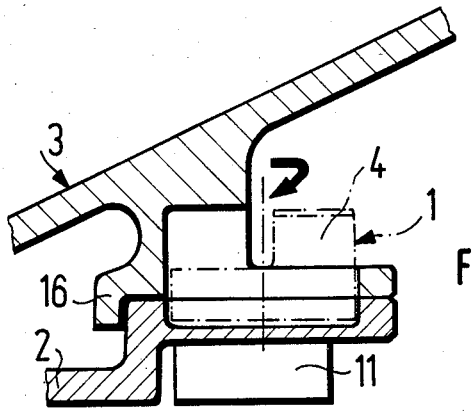

In the locked position of the components 2 and 3 as seen in FIGS. 6 and 9, angular segment 4 is engaged in recess 5 and disc portion 7' is engaged both in hollow A and bore 8. Thereby, relative axial movement of components 2 and 3, i.e., horizontally in FIGS. 6 and 9, is blocked by locking member 1 and relative circumferential movement of components 2 and 3, i.e., perpendicular to the plane of the paper in FIGS. 6 and 9 is also blocked by locking member 1. In the locked position, the face 6 extends substantially parallel to the face 7 of wall W1 of component 3, both faces being parallel to axis X—X which is coincident with the axis of the locking member.

The thickness of disc portion 7' of locking member 1 is substantially equal to the combined depth of hollow A in component 2 and bore 8 in component 3 so that in the locked position the lower surface of disc portion 7' rests on bottom wall 2*a* of component 2 while the upper surface of disc portion 7' is flush with the upper surface of component 2 as seen in FIGS. 6 and 9. The collective height of disc portion 7' and segment 4 is slightly less than the collective height of hollow A and hollow B(at recess 5) such that the locking member can be slidably accommodated in the hollows for a reason to become apparent hereinafter.

Figure 4:
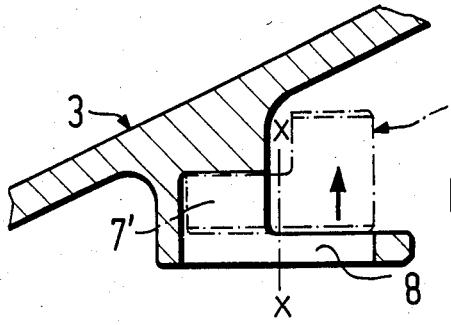
FIGS. 4, 5 and 6 illustrate, in section, a first assembly for locking the components, FIG. 6 additionally showing radial locking by a succeeding turbine stator component.
Figure 5:
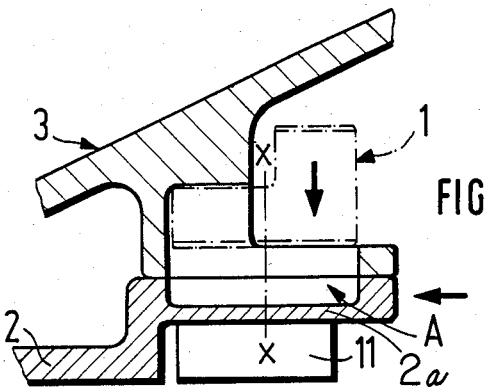

FIGS. 4 to 6 show a first assembly sequence for locking components 2 and 3 and referring to FIG. 4 therein is seen an installed stationary component 3 in which the disc portion 7' of a locking member 1 is inserted in recess 5 so that disc portion 7' abuts against the wall of the recess and is coaxial with bore 8. The locking member 1 is prevented from falling through bore 8 by application of an upward holding force as indicated by the arrow in FIG. 4. The stationary component 2 is then installed coaxially within component 3 as shown by the horizontal arrow in FIG. 5 until hollow A becomes radially aligned with hollow B. Locking member 1 is now lowered into hollow A as shown by the vertical arrow in FIG. 5 until the lower surface of disc portion 7' rests on bottom wall 2*a* of component 2. The locking member is now rotated 180° about its axis to a locking position to bring segment 4 into recess 5 as shown in FIG. 6. The slight clearance in hollows A and B of the upper face of segment 4 and the lower face of disc portion 7' provide the slidable accommodation of the locking member in the hollows which permits the rotation of the locking member between locked and unlocked positions.

Figure 7:
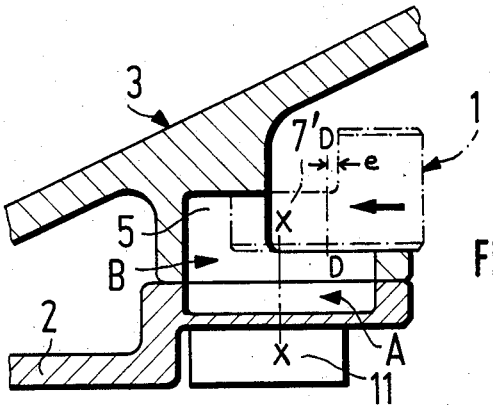
FIGS. 7, 8 and 9 illustrate, in section, a second assembly sequence for locking the components.
Figure 8:
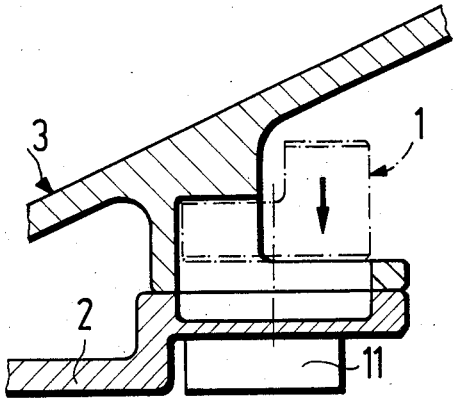

In the second assembly sequence shown in FIGS. 7–9 it is assumed that the components 2 and 3 are coaxially arranged with the hollows A and B in alignment in the initial stage of assembly as seen in FIG. 7. In this sequence, the locking member 1 is first seated from the outside by transversely pushing the disc portion 7' into the recess 5 of the component 3 as seen in FIG. 7, after which the locking member is pushed axially downwards against the bottom wall 2*a* of the hollow B in component 2 as shown in FIG. 8 and is finally brought into the locking position in FIG. 9 by rotating the locking member through 180°.

Figure 10:
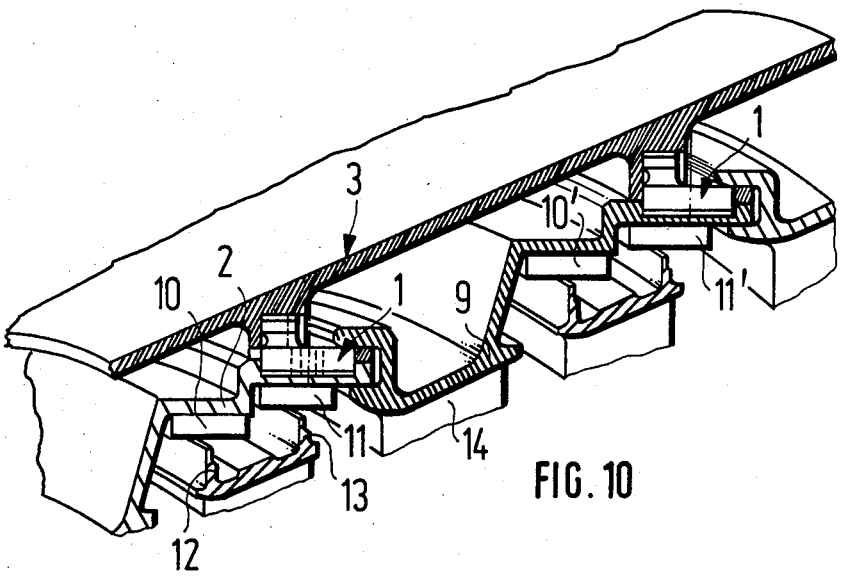
FIG. 10 is a longitudinal sectional view of a turbine illustrating the use of the device, according to the invention, in two axially spaced transverse sections of the turbine.

As it will become apparent from FIGS. 6 and 10, each pair of components 2,3 can be followed by an internal structure or stator element 9 radially holding the pair of components 2 and 3 together by embracing the adjacent ends of the components 2,3 in a fork-like manner and at least partially abutting against the upper surface of the disc portion 7' of the locking member 1.

With the embodiments of FIGS. 1 to 10, it is assumed that a plurality of locking members, preferably equally spaced circumferentially, are utilized in each common transverse turbine plane to lock the components circumferentially and axially. As it will be seen from the embodiment of FIG. 10, however, the external and internal structural components can be composed or expanded at will to suit the requisite number of turbine stages, the overall length of the turbine and the operational criteria. In the arrangement of FIG. 10, the locking members 1 and associated hollows A,B are located in axially spaced transverse planes of the respective axial flow turbine. The first component 2, which forms part of the inner turbine shroud, also serves as a support for seal members 10,11 opposite adjacent turbine rotor blade shroud tips 12,13. As also seen in FIG. 10, the first component 2 can be constructed at one end with the hollow B to form part of the axial and circumferential locking assembly with the locking members 1 arranged in a first transverse plane of the turbine, while at the other end it is formed as fork-shaped element 9 to achieve radial locking(as seen in FIG. 6)of an adjacent set of locking members 1 arranged in a second transverse plane of the turbine.

In this arrangement, component 2 can be designed not only to serve the function of a carrier for seals 10', 11', but of a carrier of stator vanes 14 arranged between two adjacent rotor blade cascades of the turbine. The component 2 at the left in FIG. 10 can also be designed in this way. The construction of FIG. 10 can also be advantageously employed in axial flow compressors of gas turbine engines.

From the above description will be evident the extreme speed and, hence, economy with which premanufactured external and internal casing components can be installed or removed, particularly in the case of multistage turbine configurations. In order to facilitate its installation or removal, each locking member 1 is provided with a central, polygonal, externally accessible socket 15 for rotating the locking member. In this manner, an Allen wrench or similar tool can be used to readily rotate the locking member 1 into its operating position for locking the components, and out of its locking position for disassembly purposes.

In a further aspect of the present invention, the first component 2 can be one of several, circumferentially successive angular segments, and each segment would come with a separate locking member 1.

The assembly operation can be further facilitated, especially when a single locking member is used, by employing mutual stop and centering means on one of the components as, for example, shown by rim 16 on component 3 in FIG. 9.

In a further advantageous aspect of the present invention, as evident from FIG. 6, the end of element 9 approaches or abuts against face 6 of segment 4 when the components are locked by the locking member to prevent rotation of the locking member to its unlocked position.

Although the invention has been described in relation to specific embodiments thereof, it will become apparent to those skilled in the art that numerous modifications and variations of the disclosed embodiments can be made within the scope and spirit of the invention as defined by the attached claims.

What is claimed is:

1. A device for axially and circumferentially locking two stationary components of a turbomachine, each of which components is at least part of a ring and wherein said components are concentrically engaged along opposed surfaces, said device comprising a locking member including a smooth, cylindrical disc portion and an axially projecting angular segment on said disc portion forming an axial step thereon, said angular segment being substantially semi-cylindrical and having an outer periphery continuous with the outer periphery of said disc portion, the components being provided with axially aligned intercommunicating hollows, the hollow of one of said components being substantially cylindrical and the hollow of the other of said components being of step form with a cylindrical portion coaxial and of the same diameter as the hollow of said one component and a substantially semi-cylindrical portion extending axially of the cylindrical portion and having a lateral opening, said locking member being engaged in the hollows of the stationary components in a locking position in which said disc portion extends in part in the hollow of said component and in part in the cylindrical portion of the hollow of said other component and said angular segment extends into said semi-cylindrical portion of said other component whereby said components are prevented from undergoing relative axial and circumferential movement, said locking member being turnable in said hollows to a release position in which said stationary components are unlocked, said cylindrical disc portion being rotatable in the hollows of both said components for movement of the locking member between the locking and release position, said angular segment being positioned and formed in relation to said semi-cylindrical portion of the hollow in said other component to emerge from said hollow in said other component through said lateral opening when said locking member rotates from the locked position to the release position, said locking member in said release position being removable from said hollow in said one component by axial displacement of the locking member relative to said components whereafter said locking member can be separated from the components.

2. A device as claimed in claim 1 wherein said other component has an L-shaped cross-section with a vertical step provided with said lateral opening, said angular segment of said locking member having a face substantially parallel to said step in said locking position.

3. A device as claimed in claim 2 wherein said locking member has an axial of rotation about which it is rotatable to engage said segment in said semi-cylindrical portion in said other component, said axis of rotation being parallel to said step.

4. A device as claimed in claim 2 wherein said cylindrical hollow in said one component and said cylindrical portion of the hollow in said other component have heights which are collectively substantially equal to the height of said disc portion.

5. A device as claimed in claim 2 wherein said hollow in said one component extends only partially of the depth thereof so that said one component has a bottom wall at the bottom of said hollow therein, said disc portion of said lockable member having a lower surface which abuts against said bottom wall with the locking member engaged in said hollows.

6. A device as claimed in claim 2 wherein said one component is an internal structural compressor or turbine component and said other component is an external compressor or turbine casing component.

7. A device as claimed in claim 6 wherein said one component comprises a guide vane and/or seal carrier.

8. A device as claimed in claim 2 further comprising means for engaging said locking member and said two components to radially lock the same together.

9. A device as claimed in claim 8 wherein said means to radially lock the components comprises a member including a fork-shaped end for embracing said components and engaging said disc portion.

10. A device as claimed in claim 9 wherein said one component includes a plurality of circumferentially successive sections each associated with a respective locking member for lockable engagement with said other component, said member with the forked shape end for each locking member being integral with the adjacent segment for the next locking member.

11. A device as claimed in claim 8 wherein said means to radially lock the components together comprises a member having an end overlapping said locking member and facing said axial step of the locking member to oppose rotation of said locking member from said locking position.

12. A device as claimed in claim 2 wherein said locking member has a central socket by which said locking member can be angularly rotated.

13. A device as claimed in claim 2 wherein said one component includes a plurality of circumferentially successive segments each associated with a respective locking member for locking engagement with said other component.

14. A device as claimed in claim 13 comprising mutual stopping and centering means on a first of said components for positioning the components so that said hollows are coaxial.

15. A device as claimed in claim 2 comprising means in said locking member for being externally engaged to rotate the locking member between said locking and unlocking positions.

16. A device as claimed in claim 15 wherein said means in said locking member for being externally engaged to rotate the locking member is a socket coaxially formed in said disc portion.

17. A device as claimed in claim 1 wherein said disc portion and angular segment of said locking member are constructed and arranged relative to said components such that to engage said locking member in said components in said locking position, said disc portion of said locking member is laterally inserted into said semi-cylindrical portion of said hollow of said other component through said lateral opening.

18. A device as claimed in claim 1 wherein said disc portion and angular segment of said locking member are constructed and arranged relative to said components such that to engage said locking member in said components in said locking position, said locking member is coaxially inserted into said other component with said disc portion engaged in said semi-cylindrical portion of said hollow.

* * * * *